United States Patent [19]

Hatakenaka et al.

[11] Patent Number: 4,561,800

[45] Date of Patent: Dec. 31, 1985

[54] METHOD OF HEATING A ROAD SURFACE AND APPARATUS THEREFOR

[75] Inventors: Toshiki Hatakenaka; Tetsuo Akiyama, both of Nishinomiya; Shinji Asada, Osaka; Kunio Shinohara, Nishinomiya, all of Japan

[73] Assignees: Chugai Ro Co., Ltd.; Kajima Road Co., Ltd., both of Japan

[21] Appl. No.: 566,143

[22] Filed: Dec. 28, 1983

[30] Foreign Application Priority Data

Dec. 29, 1982 [JP] Japan ..... 57-230129

[51] Int. Cl.[4] ..... E01L 23/14

[52] U.S. Cl. ..... 404/79; 126/271.2 A; 404/95

[58] Field of Search ..... 404/79, 77, 95; 126/271.1, 271.2 A, 250; 431/115, 116

[56] References Cited

U.S. PATENT DOCUMENTS

| | | | |
|---|---|---|---|
| 517,191 | 3/1894 | Perkins | 404/77 |
| 3,160,154 | 12/1964 | Sowell | 126/271.2 A |
| 3,221,617 | 12/1965 | Quigg | 404/95 |
| 4,061,463 | 12/1977 | Bennett | 431/116 |
| 4,261,669 | 4/1981 | Edo | 404/79 |

*Primary Examiner*—Stephen J. Novosad
*Assistant Examiner*—William P. Neuder
*Attorney, Agent, or Firm*—Jackson & Jones

[57] ABSTRACT

A method of and an apparatus for heating a road surface, in which hot air controlled to a predetermined temperature is blown against the road surface so as to heat the road surface. The apparatus includes a hot air generator provided with a burner and a thermal control unit, and a duct formed with blowing pores for blowing the hot air against the road surface.

5 Claims, 5 Drawing Figures

METHOD OF HEATING A ROAD SURFACE AND APPARATUS THEREFOR

BACKGROUND OF THE INVENTION

1. Field of the Invention

The present invention generally relates to a heating method and an apparatus therefor and more particularly, to a method of heating a road surface and an apparatus therefor.

2. Description of the Prior Art

Conventionally, in previous repair work of roads paved with asphalt concrete, it has been so arranged that, prior to the repair work, the road surfaces are softened through heating thereof by road surface heating apparatuses, each mounted on a vehicle. The known road surface heating apparatuses usually employ, for example, direct flame type burners, infrared burners or radiant heaters.

However, the known road surface heating apparatuses have such inconveniences that, since a plurality of burners are used independently of each other, adjustments of the burners are troublesome and it is difficult to adjust the thermal capability of the known road surface heating apparatuses uniformly according to the site conditions. Meanwhile, the known road surface heating apparatuses that are provided with the direct flame type burners or the infrared burners have been disadvantageous in that there is a difference in the heating temperature between one road surface portion confronting the burners and another road surface portion not confronting the burners and there is a strong possibility that the road portion confronting the burners will emit black smoke due to overheating thereof, thereby resulting in extremely difficult adjustments of the burners.

Furthermore, the prior art road surface heating apparatuses have such a disadvantage that the thermal efficiency for heating the road surfaces is extremely low.

SUMMARY OF THE INVENTION

Accordingly, an essential object of the present invention is to provide an improved method of heating a road surface, in which hot air controlled to a predetermined temperature is blown, through recycling thereof, from a slit or a plurality of blowing pores against the road surface so as to raise its thermal efficiency, with substantial elimination of the disadvantages inherent in conventional methods of this kind.

Another important object of the present invention is to provide an improved road surface heating device of the above described type, which is simple in structure, highly reliable in actual use and suitable for mass production at low cost.

In accomplishing these and other objects according to one preferred embodiment of the present invention, there is provided an improved method of heating a road surface, comprising the step of blowing against the road surface hot air controlled to a predetermined temperature so as to heat the road surface.

In accordance with the present invention, since the hot air controlled to the predetermined temperature is blown at a high velocity from a number of the blowing pores against the surface of the road paved with asphalt concrete, the road surface is heated to a uniform temperature.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
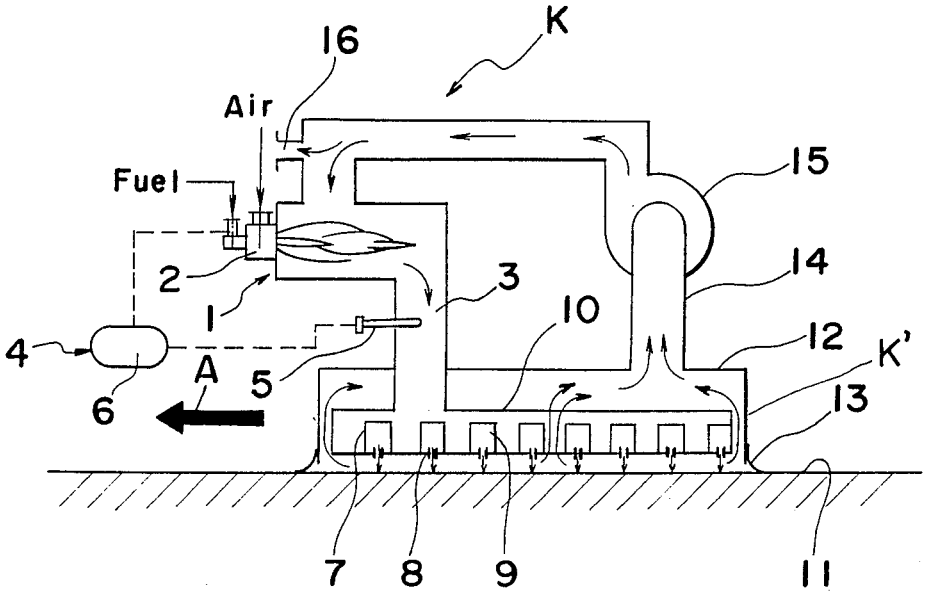
FIG. 1 is a schematic view of a road surface heating apparatus according to one preferred embodiment of the present invention.
Figure 2:
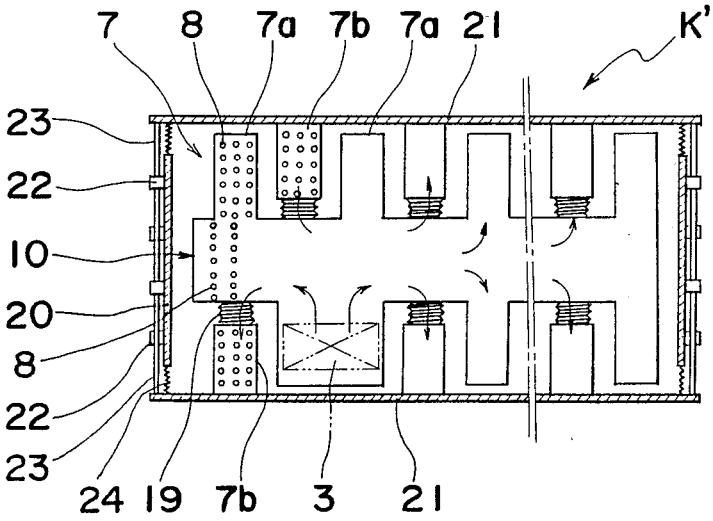
FIG. 2 is a horizontal sectional view of the apparatus of FIG. 1, with movable branch ducts employed therein being located at the retracted position.
Figure 3:
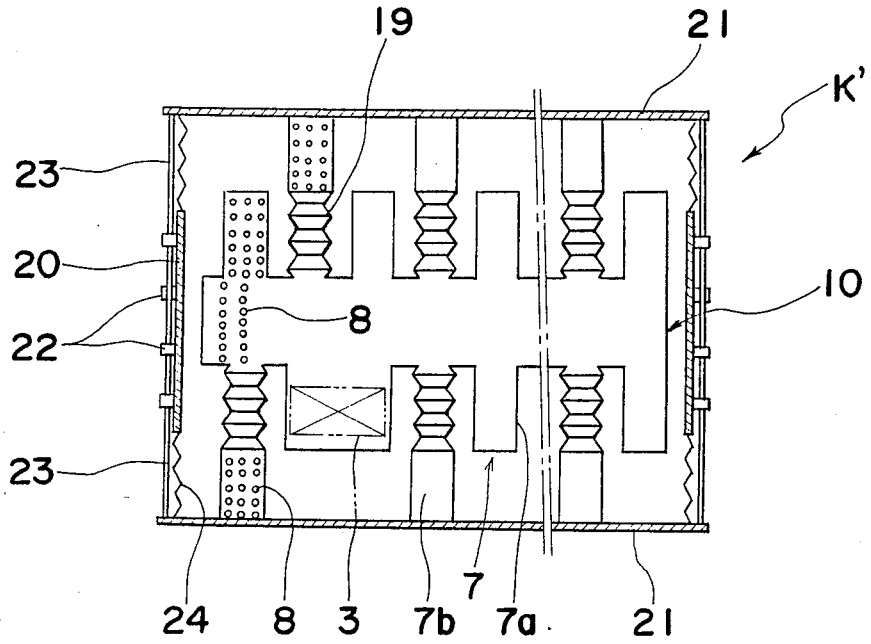
FIG. 3 is a view similar to FIG. 2, particularly showing the movable branch ducts located at the projected position.

Referring to FIGS. 1 to 3, there is shown a circulating hot air type road surface heating apparatus K according to one preferred embodiment of the present invention, which is arranged to be mounted on a vehicle such that the road surface heating apparatus K is moved by the vehicle in the leftward direction shown by the arrow A. The road surface heating apparatus K generally includes a hot air generator 1, a plurality of ducts 7 each having a number of blowing pores 8 (nozzles or slits) formed at a lower face thereof, a hood 12 for housing the ducts 7 therein, and a connecting duct 14 for communicating the hood 12 with the hot air generator 1, with the connecting duct 14 having a circulating fan 15 incorporated therein.

Meanwhile, the hot air generator 1 includes a direct flame type burner 2 incorporated therein and a thermal control unit 4 which is composed of a thermocouple 5 disposed in a supply duct 3 and a temperature controller 6. It is so arranged that the temperature of the hot air heated by the direct flame type burner 2 is detected by the thermocouple 5 so as to be controllable to a preset temperature by the temperature controller 6 through adjustments of the feed rates of both the fuel and air.

The ducts 7 are provided in a header 10 in communication with the supply duct 3 such that the hot air controlled to the predetermined temperature, which is introduced from a side opening 9 of each of the ducts 7, is directly blown against a road surface 11 from a number of the blowing pores 8 formed on the lower face of each of the ducts 7.

As described above, the hood 12 covers the duct 7 (the header 10 in this embodiment) and is communicated, at its upper portion, with the hot air generator 1 through the connecting duct 14 provided with the circulating fan 15 such that a large portion of the hot air blown from the blowing pores 8 against the road surface 11 is returned to the hot air generator 1. Furthermore, a curtain or a peripheral heat seal member 13 made of, for example, asbestos, is provided at a lower periphery of the hood 12 so as to prevent the hot air blown from the blowing pores 8 against the road surface 11 from leaking out of the hood 12 as much as possible. In addition, a discharge port 16 for exhaust gas is provided in the connecting duct 14 so as to be disposed above the direct flame type burner 2.

As shown in FIGS. 2 and 3, the road surface heating apparatus K includes a blower or plenum section K' comprising a main frame 20 and a pair of movable frames 21 which are movably mounted on the main frame 20 so as to be moved in a sidewise direction of the main frame 20. Meanwhile, the ducts or nozzle members 7 extend outwardly from opposite side walls of the header 10 towards the corresponding movable frames 21. The header 10 also has a number of the blowing pores or apertures 8 formed at a lower face thereof. The ducts 7 include fixed branch ducts 7*a* integrally formed with the header 10 and movable branch ducts 7*b* which are each retractably mounted, at one end thereof, on the header 10 through a metallic bellows 19, while the other end of each of the movable branch ducts 7*b* is secured to each of the movable frames 21, so that the movable branch ducts 7*b* are displaced in the sidewise direction of the main frame 20 together with the movable frames 21. More specifically, one pair of guide bars 23 are each slidably mounted on one end of the main frame 20 through one pair of upper and lower bearings 22 which are attached to the one end of the main frame 20, with distal ends of the guide bars 23 being, respectively, secured to the movable frames 21. Likewise, another pair of the guide bars 23 are each slidably mounted on the other end of the main frame 20 through another pair of the upper and lower bearings 22 and are secured, at distal ends thereof, to the movable frames 21, respectively. Furthermore, one pair of bellows 24 are, respectively, provided adjacent to one end of the main frame 20 between the main frame 20 and one of the movable frames 21 and between the main frame 20 and the other one of the movable frames 21. In the same manner as described above, another pair of the bellows 24 are provided adjacent to the other end of the main frame 20. The movable frames 21 are arranged to be displaced manually or by a driving mechanism such as a remote-controlled cylinder, etc., whereby the movable branch ducts 7*b* can be moved in the sidewise direction of the main frame 20 upon displacement of the movable frames 21.

By the above described arrangement of the road surface heating apparatus K, air fed by the circulating fan 15 is mixed with heated air produced by the direct flame type burner 2 so as to be converted into hot air including combustion gas of a high temperature controlled to the predetermined temperature by the thermal control unit 4 of the hot air generator 1 and then, the hot air is blown from the blowing pores 8 against the road surface 11 through the supply duct 3, the header 10 and the ducts 7 so as to soften the road surface 11 through heating thereof. Subsequently, the hot air whose temperature has dropped due to heat transfer therefrom to the road surface 11 is sucked by a suction force of the circulating fan 15 into the hood 12 through a clearance between the header 10 and the hood 12 together with atmosphere infiltratively admitted into the hood 12 via the curtain 13 so as to be returned to the hot air generator 1 through the connecting duct 14. Namely, most of the portion of the hot air blown from the blowing pores 8 against the road surface 11 can be recycled in the road surface heating apparatus K.

It is to be noted here that the road surface 11 is sequentially heated by the road surface heating apparatus K upon movement of the road surface heating apparatus K by the use of the vehicle and thereafter, repair work of the road surface 11 is performed. Meanwhile, although the direct flame type burner 2 is employed in the hot air generator 1 in this embodiment, the direct flame type burner 2 may be replaced by an indirect heating type burner. Furthermore, although hot air for heating the road surface is recycled in this embodiment, it is needless to say that it can be also so arranged that the hot air is not recycled.

Meanwhile, even if such a problem is encountered that a width of a portion of the road surface 11, which portion is subjected to repair work, changes, the movable branch ducts 7*b* can be moved in the sidewise direction of the main frame 20 upon displacement of the movable frames 21 as shown in FIGS. 2 and 3 so as to cover the portion of the road surface 11, whereby the above described problem can be solved with much ease.

Figure 4:
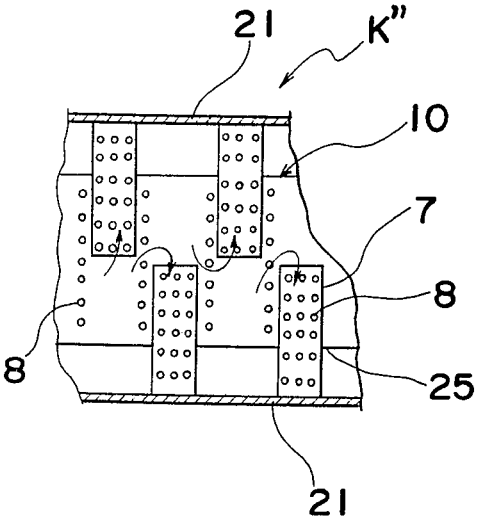
FIGS. 4 and 5 are views similar to FIGS. 2 and 3, respectively, particularly showing a modification thereof.
Figure 5:
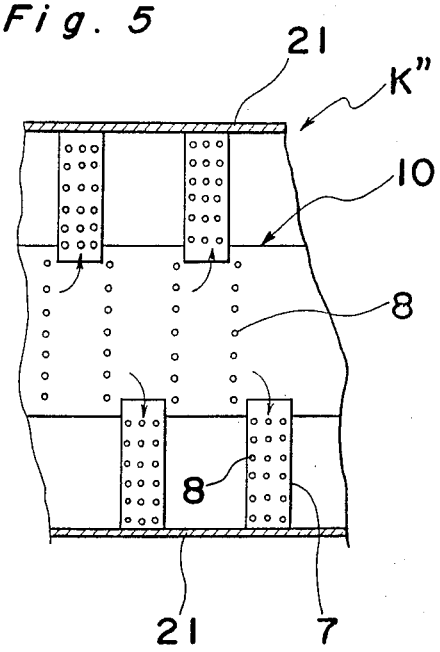

Furthermore, although the ducts 7 include the fixed branch ducts 7*a* and the movable branch ducts 7*b* in the blow section K', there is shown in FIGS. 4 and 5, a blow section K'' which is a modification of the blow section K'. In the modified blow section K'', each of the ducts 7 is secured, at one end thereof, to each of the movable frames 21 and is slidably supported, at the other end, by the header 10 through a seal 25 such that all the ducts 7 act as the movable branch ducts 7*b*. In the modified blow section K'', it can also be so arranged that the blowing pores 8 are not formed on the header 10 such that the hot air is fed only to the ducts 7.

As is clear from the foregoing description, in accordance with the present invention, since the hot air controlled to the predetermined temperature is blown at a high velocity from a number of the blowing pores against the surface of the road paved with asphalt concrete, the road surface is heated to a uniform temperature. Consequently, in accordance with the present invention, since the road surface is not locally heated to high temperatures, such an undesirable phenomenon does not take place that the surface of the road paved with asphalt concrete emits black smoke due to ignition and subsequent burning of asphalt surface thereof.

Furthermore, in accordance with the present invention, since adjustments of temperature of the hot air are performed on the basis of the temperature of the hot air itself supplied to the blowing pores, the thermal capability of the road surface heating apparatus can be adjusted with much ease.

Moreover, in accordance with the present invention, since the road surface is heated by the hot air itself produced by the direct flame type burner and most of the portion of the hot air whose temperature has dropped due to heat transfer therefrom to the road surface is recycled, the thermal efficiency of the road surface heating apparatus has been remarkably raised by 50–70% in comparison with those of conventional apparatuses, thereby resulting in a great saving of energy therefor.

In addition, in accordance with the present invention, since the ducts can be moved in the sidewise direction of the road surface heating apparatus, such a problem can be solved with much ease that the portion of the road surface, which is subjected to repair work, changes in width, thus rendering the road surface heating apparatus highly suitable for practical use.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A method of subjecting a roadbed surface to air heated by a burner to prepare the surface for repair work comprising:

(a) raising the temperature of air adjacent the burner to a predetermined temperature;

(b) forcing the heated air into contact with the road surface;

(c) collecting the exhausted hot air which has been blown against the road surface; and (d) returning the exhausted hot air to the burner.

2. The method of claim 1 wherein the step of raising the temperature of the air to a predetermined temperature includes:

monitoring the temperature of the heated air downstream from the burner; and controlling the amount of fuel and air supplied to the burner in accordance with the monitored temperature.

3. In a road surface heating apparatus for applying hot air to an asphalt concrete roadbed surface to soften the same prior to initiating repair work, the combination which comprises:

(a) a supply duct having an upstream and a downstream end;

(b) a burner disposed in said duct;

(c) temperature sensing means disposed in the supply duct downstream from the burner;

(d) fuel control means coupled to the temperature sensing means and the burner for regulating the rates of fuel and air supplied to the burner to maintain the air flowing past the burner at a preset temperature;

(e) a header connected to the downstream end of the duct;

(f) a plurality of nozzle members adapted to be positioned adjacent the roadbed to be heated and connected to the header so that air flowing into the header will be directed through the nozzles and against the roadbed;

(g) a hood extending over the header and nozzle members for trapping the air exiting the nozzles against the roadbed surface; and (h) blower means connected between the hood and the upstream end of the supply duct for returning the trapped air to the upstream end of the duct whereby the air heated by the burner is continuously recirculated through the nozzle members past the roadbed surface and back to the burner.

4. The road surface heating apparatus of claim 3 wherein the hood has four outer frame walls, two of the frame walls including bellows means to permit said two walls to be moved closer or further apart to vary the width of the hood for covering different widths of roadbed surface and wherein the header includes a plurality of movable branch ducts connected to said two movable frame walls for movement therewith and a plurality of fixed branch ducts which are stationary relative to said movable frame walls, the nozzle members being carried by the branch ducts, the header further including bellows means for coupling the movable and fixed branch ducts to direct all of the heated air from the burner to the roadbed surface.

5. The road surface heating apparatus of claim 4 wherein the header includes a central duct connected between each of the branch ducts and the supply duct, the bellows means being connected between the central and the movable branch ducts.

* * * * *